United States Patent [19]

Fierro

[11] Patent Number: 4,729,132

[45] Date of Patent: Mar. 8, 1988

[54] SPORTS HELMET

[76] Inventor: Mark F. Fierro, 4145 E. Harmon, Las Vegas, Nev. 89121

[21] Appl. No.: 925,989

[22] Filed: Nov. 3, 1986

[51] Int. Cl.[4] ..... A42B 3/02

[52] U.S. Cl. ..... 2/414; 2/171.2; 2/171.4; 2/425

[58] Field of Search ..... 2/5, 6, 171.2, 171.4, 2/206, 411, 413, 414, 424, 436, 410, 425

[56] References Cited

U.S. PATENT DOCUMENTS

| | | | |
|---|---|---|---|
| 2,640,980 | 6/1953 | Prupis | 2/6 X |
| 2,813,271 | 11/1957 | Finken | 2/6 |
| 3,295,511 | 1/1967 | Crouzet | 2/205 X |
| 3,320,682 | 5/1967 | Sliman | 2/174 X |
| 3,335,720 | 8/1967 | Aileo | 2/6 X |
| 4,133,055 | 1/1979 | Zebuhr | 2/411 |
| 4,556,994 | 12/1985 | Kanasaki et al. | 2/424 |
| 4,573,217 | 3/1986 | Reed | 2/5 X |
| 4,584,721 | 4/1986 | Yamamoto | 2/424 |

FOREIGN PATENT DOCUMENTS

| | | | |
|---|---|---|---|
| 2943472 | 5/1981 | Fed. Rep. of Germany | 2/410 |
| 2279346 | 3/1976 | France | 2/414 |
| 636251 | 5/1983 | Switzerland | 2/410 |
| 539577 | 9/1941 | United Kingdom | 2/6 |
| 2046080 | 11/1980 | United Kingdom | 2/424 |
| 2133971 | 8/1984 | United Kingdom | 2/411 |

*Primary Examiner*—Wm. Carter Reynolds
*Attorney, Agent, or Firm*—Seiler, Quirk & Tratos

[57] ABSTRACT

A sports helmet has a resilient, cushioned lining in the interior having at least one pocket in a rear portion containing an air-activated heat-generating element. The helmet is fabricated with an adjustable interior lining having a plurality of pieces which fit into the interior of the helmet shell. A nose and mouth-covering portion of the lining is constructed from two separate lining members having a plurality of strategically located hook-and-listeners which enable the lining interior to be custom shaped to fit the face of each wearer. The lining members form a conduit to side vents in the helmet, thereby preventing exhalation from fogging the transparent face shield of the helmet.

6 Claims, 7 Drawing Figures

SPORTS HELMET

BACKGROUND OF THE INVENTION

This invention relates to a protective helmet of the type used by skiers or cyclists for protection against injury caused by high-speed impact. The helmet of the invention is particularly useful for skiers, and includes means for generating heat in the interior of the helmet, and an adjustable cushioned face protector to maintain the user's face at a comfortable temperature while preventing the user's breath from fogging the face shield. In addition, connections for a tape deck and a two-way radio are also provided for optional use.

Special purpose helmets to protect a wearer from impact injury are of course well-known. Refined helmet designs have provided a variety of features which are designed to make these helmets more comfortable, functionable, or enjoyable. A basic helmet having an interior shell and a nose cover designed to deflect the exhalation of a wearer away from the windshield is described in Kawasaki, U.S. Pat. No. 4,556,994. A cyclist's helmet having an aperture in the chin-piece along with a conduit to deflect incoming air toward the face shield is shown in Schnitzler, U.S. Pat. No. 4,538,303.

It is also known to incorporate stereo headphones or a two-way transmitting radio into helmets. For example, Von Statten, U.S. Pat. No. 4,109,105 discloses a motorcycle helmet having stereo earphones and a connecting cord which attaches to a tape deck mounted on the frame of a motorcycle. The use of receiving and transmitting devices in connection with a helmet has been disclosed in U.S. Pat. Nos. Nava, 4,471,174, Drefko, 4,357,711, Campbell, 3,916,312, Whittemore, 3,249,873, Sarles, 2,904,645, and Ceriello, 2,329,457.

The incorporation of certain heating means in connection with headgear is also known. Sliman, U.S. Pat. No. 3,320,682 describes a curler bonnet having heat-generating crystals sewn into the fabric. Kerr, U.S. Pat. No. 3,858,028 discloses an entire heated cyclist's suit, with a head covering portion having electrical resistance heating wire running throughout. Crouzet, U.S. Pat. No. 3,295,511 discloses a novel helmet which is heated by an alcohol lamp. Ripley, U.S. Pat. No. 2,460,433 also shows a hat heated by means of resistance wire.

The invention provides a sports helmet that has a combination of features to provide the ultimate in comfort, safety, and entertainment of the wearer. The helmet is particularly useful for skiers who operate in extremely cold climates, providing a heat-generating source to keep the wearer's head warm for 6–8 hours. In addition, the helmet contains a specially designed lining which provides a respiratory channel connecting the wearer's nose and mouth with an exterior vent, and which precludes exhalation on the interior of a transparent face shield which might create fogging. Optional two-way radio transmitter and stereo tape deck are also provided.

Accordingly, it is an object of the present invention to provide a sports helmet, particularly for skiing and cycling, which has an impact resistant exterior, a resilient, comfortable interior, and a replaceable interior heat generating device for maintaining the wearer's head at a comfortable temperature in a cold exterior environment. It is a further object of the invention to provide a helmet having an easily attached, portable stereo tape deck and a two-way radio transmitter. It is yet a further object of the invention to provide a sports helmet having an adjustable lining portion which fits snugly against the user's face to provide a breathing channel which communicates through a vent in the helmet with the exterior, and which prevents exhalation onto a transparent face shield. These and other objects of the invention are accomplished by the helmet described and claimed herein.

BRIEF SUMMARY OF THE INVENTION

A sports helmet has a rigid, impact-resistant exterior shell having openings in the downward and forward portions thereof. The forward opening is covered by a transparent, retractable face shield. A resilient, cushioned lining in the interior of the shell has at least one pocket in a rear portion thereof to receive a chemical heat-generating packet. A removable mouth-covering lining member, and a separate nose cover are assembled in a forward portion of the shell. The nose cover has a flange portion adapted to engage the nose and cheek area of a user's face, and is adjusted by means of a pair of Velcro ® straps which attach to the mouth-covering lining member. The helmet is optionally equipped with stereo earphones which connect to a phone jack mounted in the shell exterior to receive the male jack of a tape deck. Mounting means is also provided on the exterior of the helmet for a two-way radio transmitter.

BRIEF DESCRIPTION OF THE DRAWINGS

The invention is best understood with reference to the drawings, in which.

DETAILED DESCRIPTION OF A PREFERRED EMBODIMENT

Figure 1:
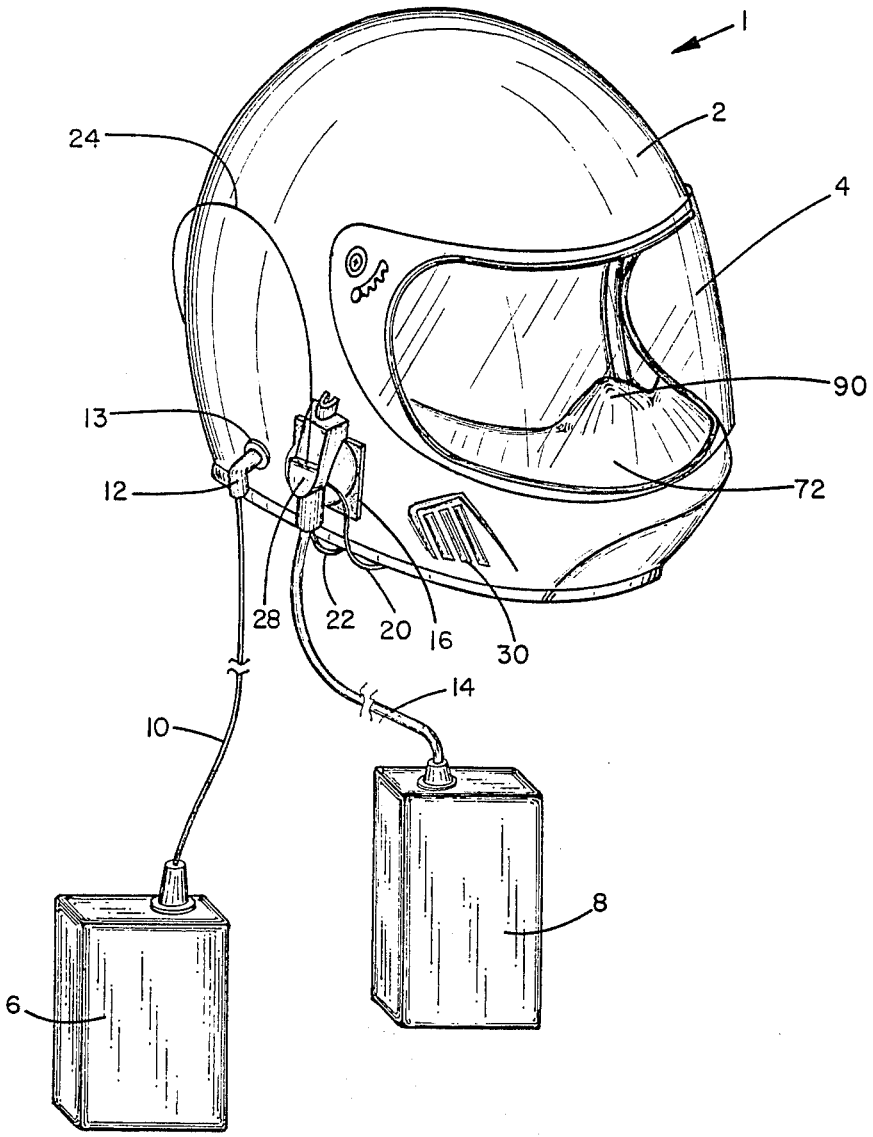
FIG. 1 is a perspective, partially diagramatic view showing the helmet of the invention with a tape deck and two-way radio transmitter attached thereto.

Referring first to FIG. 1, helmet 1 is fabricated from a rigid, impact resistant outer shell 2 made from molded Fiberglas or impact resistant plastic such as high impact polystyrene, polypropylene, or polycarbonate. The helmet has a generally planar bottom or downward opening to receive the wearer's head, and a forward opening retractably covered by a transparent face shield 4. The face shield is preferably made from an anti-fog, anti-glare plastic, and may be a Polaroid ® material. Optional accompanying features to the helmet are a tape deck 6 to provide stereo music or other entertainment to the wearer, and a two-way radio 8 for communication with other skiers or cyclists or with a base. The tape deck may be any commercially available model, such as a Sony Walkman, or may be a micro-cassette or mini-cassette player which is easily portable and can be carried in a skier's pocket. The tape deck is connected to the helmet by an electrical cord 10 which terminates in a male plug jack 12 which press-fits into a female plug 13 mounted in the helmet shell 2.

Figure 2:
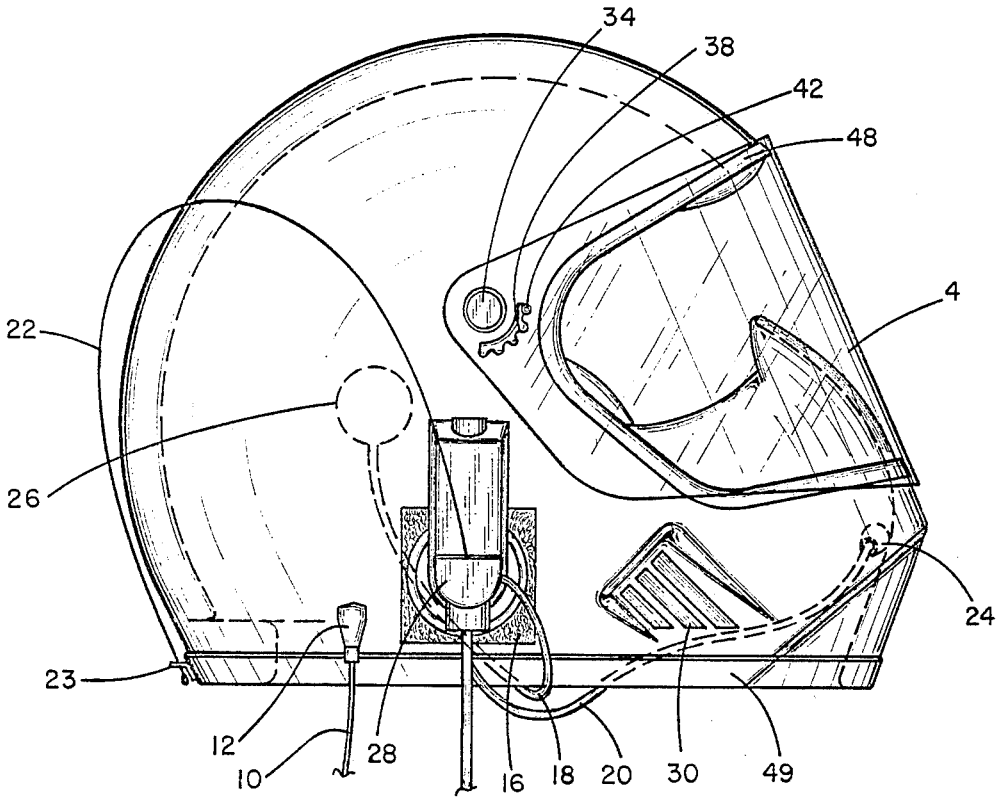
FIG. 2 is a side view thereof showing some of the interior components in phantom.

The two-way radio transmitter is also a conventional, commercially available unit such as a Maxon model 49-HI helmet communicator. These units are typically used in motorcycle helmets for communication between an operator and a passenger. It has been found that these communicators are also operable to provide communication between two skiers. The transmitter 8 connects to an antenna mount 28 by means of a cord 14. The antenna mount is frictionally connected by a pair of adhesively mounted Velcro® strips; a Velcro® patch 16 is attached to the helmet, and connects with a mating Velcro® strip (not shown) mounted on the antenna mount. An antenna 22 is connected to an antenna clip 23 (see FIG. 2) when the antenna is not in use. As also seen in FIG. 2, an electrical wire 18 extends from the antenna mount to an earphone 26 mounted interior of the helmet in the vicinity of the wearer's ear; a similar wire 20 connects the transmitter with a speaker microphone 24 which is mounted on a flexible cable and is located in an interior forward portion of the helmet approximate to the wearer's mouth.

Figure 4:
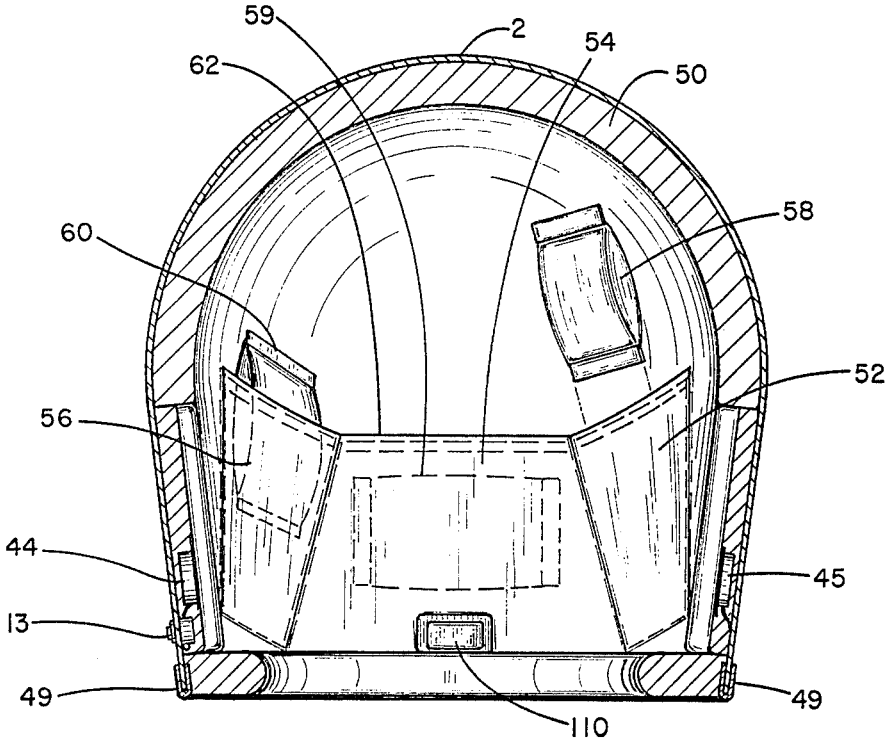
FIG. 4 is a front view sectioned along a vertical plane at approximately the mid-point of the helmet.

A miniature battery-operated radio transmitter 110 is optionally embedded in the lining at the base of the rear of the helmet as shown in FIG. 4. The purpose of the transmitter is to enable locating a skier or snowmobiler lost in deep snow or in an avalanche. The transmitter would emit a periodic signal on a predetermined frequency which can be detected by a properly tuned receiver. Any commercially available transmitter which fits in the helmet can be used.

A pair of air vents 30 and 31 located on either side of the helmet permit the inhalation and exhalation of fresh air by the the wearer. The placement of the air vents is best seen in FIG. 3.

Figure 3:
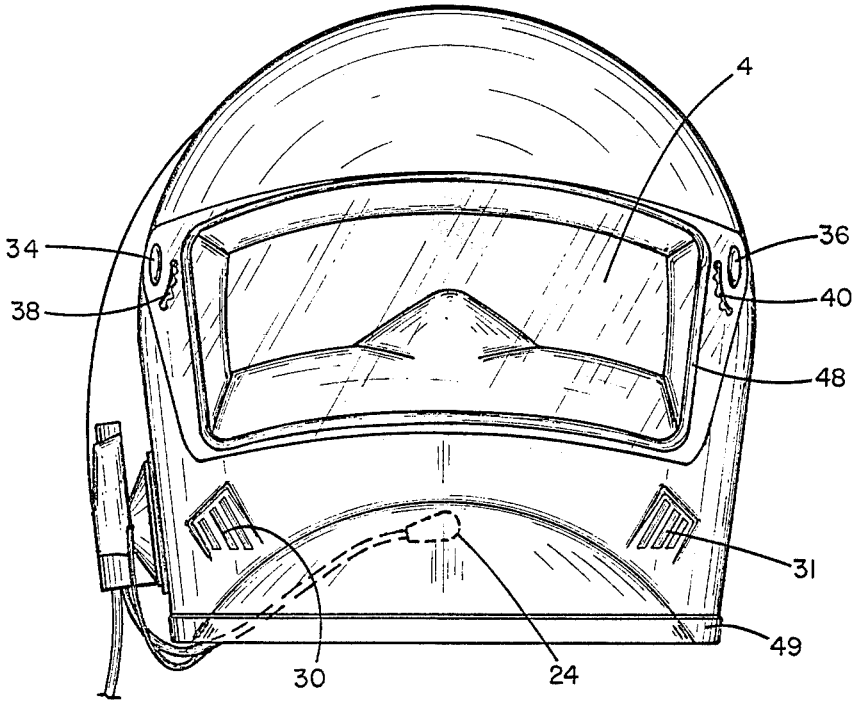
FIG. 3 is a front view thereof.

The face shield 4 is hingedly mounted on the shell by dowel pins 34 and 36 (see FIG. 3). The attitude of the face shield is fixed by means of a pair of grooves 38 and 40 having a set of spaced teeth or detents in the lower portion of the groove, and a biased plastic lug 42 which is fixed with respect to the shell. The lug is fabricated from a slightly resilient elastomer which is biased towards the bottom of the detents but which is urged upwardly by the tooth portions of the detents when the face shield is lifted. Accordingly, the face shield can be manually lifted and will remain in a retracted position corresponding to one of the detents. The face shield can be removed to the fully covered position shown in FIGS. 2 and 3 simply by pushing the face plate downwardly. A rubber bead 48 extends around the periphery of the opening at the forward portion of the helmet in order to provide a cushion and seal for the face plate. A similar bead 49 extends around the bottom head-receiving opening of the helmet.

Figure 5:
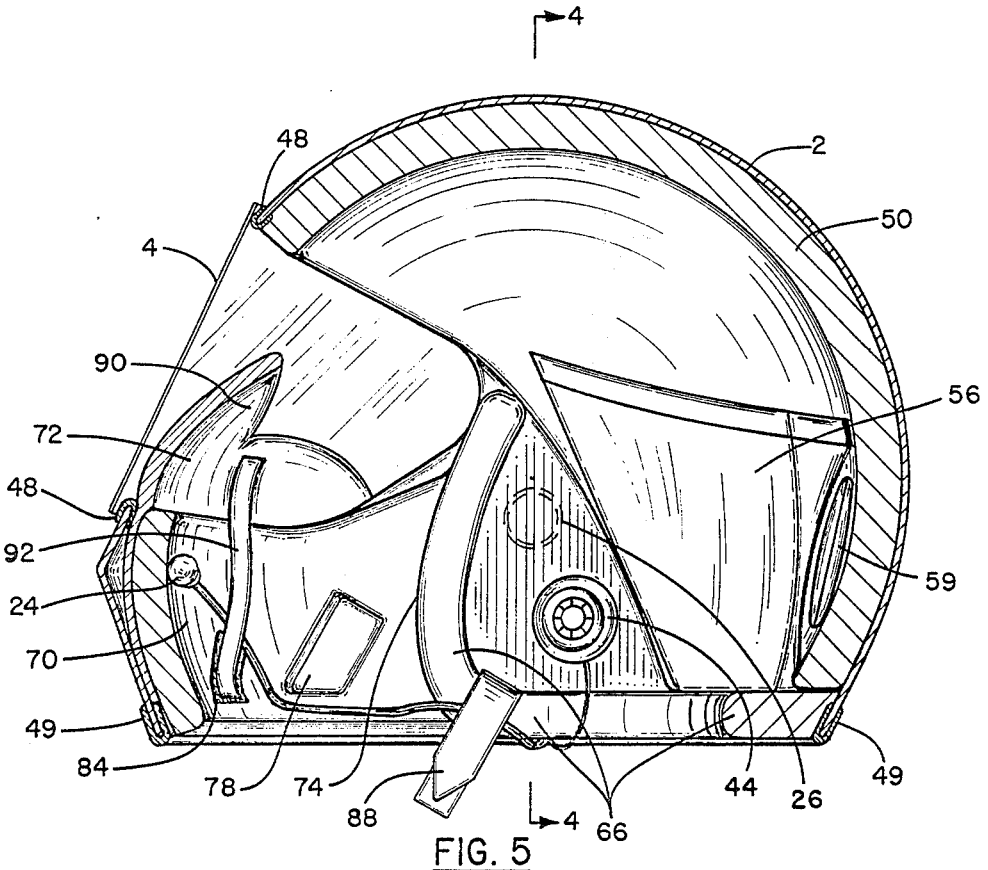
FIG. 5 is a side view thereof sectioned along a vertical plane at approximately the mid-point of the helmet.

The entire interior surface of the helmet is lined with a resilient, felt-coated, foam lining. This lining is included to provide a snug, comfortable fit for the wearer to cushion against any possible shock and to provide insulation from the cold. As seen in FIGS. 4 and 5, a rear portion of the lining 50 consists of a single sheet of foam material which is glued to the interior of the shell. The lining has a thickness of about ½". Of particular importance to the invention are a series of pockets 52, 54, and 56 on the interior of the lining in which small, chemical heat-generating packets 58, 59, and 60 can be mounted. The mounting means for the packets simply consists of a fabric portion sewn into the interior lining as shown in FIG. 4 having upwardly opening apertures. The heat generating packet simply slides into the pocket, which is then closed by means of conventional hook-and-loop fasteners (such as Velcro® fasteners) 62 which line the interior of the pocket and the corresponding portion of the lining. The heat packets used in the invention are commercially available components which generate warmth continuously over a 6–8 hour period.

Chemical heating packets 58, 59 and 60 may be any device which generates substantial heat by means of a chemical reaction, but preferably comprises a solid granular material which generates an exothermic reaction on exposure to air. Typically, an air-activated chemical heating element comprises finely divided elemental iron and certain salts packaged in an air-permeable enclosure. An example is the hand warmer marketed commercially as HandiHeat® handwarmer, which consists of iron powder, water, salt, and activated charcoal, and which is manufactured by Hakugen Co., Ltd., of Tokyo, Japan. Another example is a warm pack marketed under the mark "Heat Factory®" by The Heat Factory, Inc., of Mission Viejo, Calif. The granular materials are packaged in an air-permeable packet which is enclosed in an air-tight plastic envelope. When the envelope is removed and the packet is exposed to air, the oxidation of the iron produces a steady heat at about 130°–150° F. for 5–7 hours. If the packet is replaced in the air-tight envelope during its useful life, the reaction stops and will restart on re-exposure to air. These packets are flat members having a thickness of less than about ¼", and preferably not more than ⅛", and thus can fit easily into the lining pockets.

As seen in FIG. 4, small stereo earphones 44 and 45 are located at approximately the mid-point of the helmet in the vicinity of the wearer's ears. An L-shaped lining flange 66 extends around the rear portion of the bottom opening of the helmet, and extends upwardly just forwardly of the wearer's ears. This flange extends inwardly about ½" from the helmet wall, and provides a comfortable snug fit around the user's neck and face. This flange also prevents cold air from entering the rear portion of the helmet, and warm air from leaving it.

Figure 6:
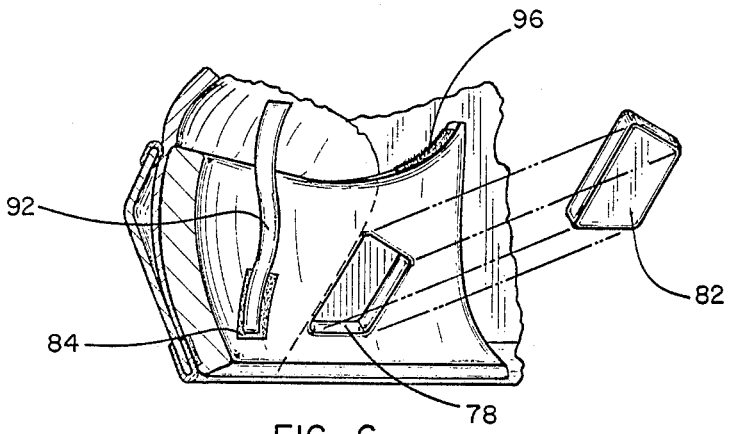
FIG. 6 is a partial view showing the forward lining members.

A very important feature of the invention relates to the construction of the lining at the forward interior portion of the helmet. Seen in FIGS. 4–7, the forward portion of the lining comprises two entirely separate removable lining members 70 and 72. A mouth covering portion of the lining 70 is approximately ⅜" thick and is symmetrical about a central vertical plane, having contoured end portions 74 and 76 to engage the fixed flange portion of the lining 66. The mouth portion of the lining has a pair of generally rectangular shaped apertures 78 and 80 which register with the breathing vents 30 and 31 to permit the passage of air into and out from the helmet. If it is desired to close the opening, as shown in FIG. 6 a removable plug 82 formed from the same material as the lining is adapted to simply press fit into the aperture 78. The vents are normally left open, but would be plugged during high speed runs when the circulating air is moving fast enough to draw the skier's breath out through the bottom of the helmet.

The nose-covering portion 72 of the lining is also completely removable (i.e., is not attached to the shell) and is located between the shell and the mouth-covering portion of the lining. The nose-covering portion is relatively thin and flexible, having a thickness of approximately ⅛–¼". The nose-covering lining portion has a projection or lip 90 designed to fit comfortably over the user's nose, and to direct air flow away from the face shield 4 into the conduit formed by the front lining members, the breathing apertures in the lining, and the air vents. The nose-covering portion may be removed as unnecessary if the helmet is used in very dry climates.

The attitude of the nose-covering portion is adjusted for each particular user's face by a pair of Velcro® straps 92 which are fixedly attached to the interior of the nose-covering member and extend downwardly over the interior of the mouth-covering member, where the free end of the strap is attached by means of a Velcro® fastener to the inside of said member. A Velcro® fastening pad 84 is adhesively attached to the interior surface of lining member 70. By adjusting the location of attachment of the strap 92 to the pad 84, a comfortable, snug fit of the nose piece may be obtained. As is shown in FIG. 5, the strap can also be used to hold the microphone 24 for the two-way radio in place.

Figure 7:
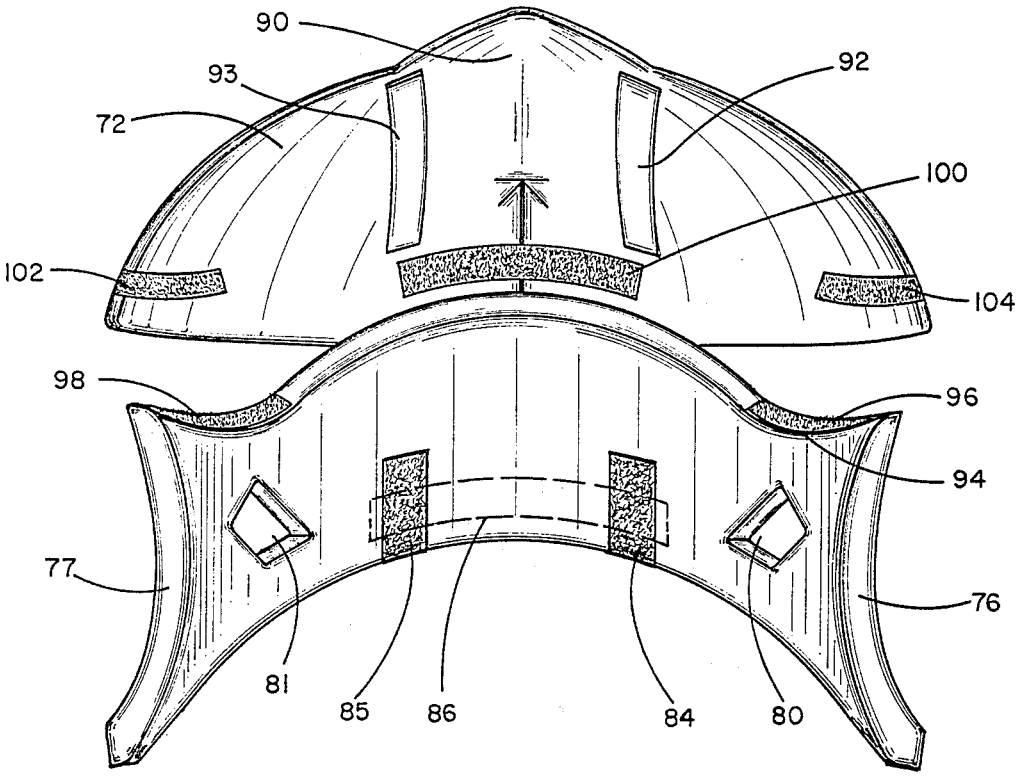
FIG. 7 is an exploded view showing the mouth covering lining member and the nose cover.

The relationship of the mouth-covering member 70 and the nose piece 72 are better seen in FIG. 7. While these two pieces are not fastened to the interior of the helmet shell but are maintained in place simply by friction fit with the other lining members, they are attached to each other by means of the straps 92 and 93 as well as a separate Velcro® fastener 86 which is adhesively attached to a forward portion of the mouth-covering member and which connects with an interengaging fastening member correspondingly located on the interior of the nose piece. An additional fastening member 100 is mounted on the forward interior portion of the nose piece, and engages a similar piece 86 mounted on the forward portion of the mouth-covering member. These members impart additional stability for the two forward lining members to maintain their location at the desired adjustment. In order to assist in maintaining proper attitude of the nose piece relative to the wearer's face, a pair of Velcro® hook patches 96 and 98 are adhesively attached to the top edge 94 to the mouth-covering member. Because the nosecovering member has a felt fabric exterior, the hook members of the Velcro® fastening patch naturally engage the fabric material to provide a certain fastening capability. Accordingly, when the nose-covering member is pressed into place over the wearer's face, these fastening members 96 and 98 will assist in maintaining the desired configuration of the nose-covering member. Of course, mating loop-type fastening patches can be attached to the interior of the nose-covering member if desired. Similar Velcro® hook strips 102 and 104 mounted on the rear of the nose-covering member attach to the fabric on the forward panel of the mouthpiece for stability.

The helmet is secured to the user's head by a chin strap 88 which is adjustable for comfort and is of conventional design.

Various additions and alterations may be made to the helmet of the invention within the spirit and scope of the invention described herein. Accordingly, the preceding description of a preferred embodiment of the invention should not be construed as limiting; rather, the invention should be limited only by the following claims.

I claim:

1. A sports helmet having a rigid, impact resistant exterior shell with a downward head receiving opening, a front opening having a retractable shield for covering said front opening, and a resilient, cushioned lining interior of the shell, at least one mounting means in a rear interior portion of the cushion lining for removably mounting an air-activated chemical heating element, and a separate mouth-covering lining member removably mounted in a forward portion of the shell.

2. The helmet of claim 1 also comprising at least one ear phone, and connecting means for attaching said ear phone to an audio signal generator.

3. The helmet of claim 1 also comprising an ear phone, a microphone, mounting means on the exterior of the helmet for removably attaching radio communication means, and an antenna electrically coupled to the radio transmission means.

4. A sports helmet having a rigid, impact resistant exterior shell with a downward head receiving opening, a front opening having a retractable shield for covering said front opening, and resilient, cushioned lining interior of the shell, a separate mouth-covering lining member removably mounted in the forward portion of the shell, a separate nose-cover removably mounted in a forward portion of the shell, said cover having a flange portion adapted to engage the nose and cheek area of a user's face, fastening means for removably attaching the nose-cover to the mouth-covering lining member, adjustment means for varying the attitude of the flange portion of the nose-cover relative to the mouth-covering lining member and an opposed pair of vent means in side portions of the shell, a pair of apertures in the lining aligned with the apertures, and removable plug means for closing the apertures in the lining.

5. The sports helmet of claim 4 also comprising signal transmitting means to enable location of the helmet in an emergency.

6. In combination, a sports helmet having rigid, impact resistant exterior shell with a downward head-receiving opening, a front opening having a retractable shield for covering said front opening, and a resilient, cushioned lining interior of the shell, and a plurality of mounting means in a rear interior portion of the cushioned lining for mounting a plurality air-activated chemical heating elements, and a plurality of air-activated chemical heating elements removably mounted in the mounting means comprising iron powder and activated charcoal in an air permeable packet having a thickness not greater than ¼".

* * * * *